United States Patent [19]

Reichert et al.

[11] Patent Number: 4,715,745

[45] Date of Patent: Dec. 29, 1987

[54] GROUND ANCHOR SYSTEM

[75] Inventors: Ernst Reichert, Pöring; Karl Schütt, Langenfeld, both of Fed. Rep. of Germany

[73] Assignee: Stump Bohr GmbH, Ismaning, Fed. Rep. of Germany

[21] Appl. No.: 858,185

[22] PCT Filed: Jul. 12, 1985

[86] PCT No.: PCT/DE85/00241

§ 371 Date: May 5, 1986

§ 102(e) Date: May 5, 1986

[87] PCT Pub. No.: WO86/00655

PCT Pub. Date: Jan. 30, 1986

[30] Foreign Application Priority Data

Jul. 13, 1984 [DE] Fed. Rep. of Germany ..... 3425941

[51] Int. Cl.[4] ..... E02D 5/76

[52] U.S. Cl. ..... 405/262; 405/233; 405/239

[58] Field of Search ..... 405/262, 239, 233, 237, 405/238, 240–243

[56] References Cited

U.S. PATENT DOCUMENTS

| | | | |
|---|---|---|---|
| 2,555,951 | 6/1951 | Allard | 405/239 X |
| 3,226,933 | 1/1966 | White | 405/262 |
| 3,309,878 | 3/1967 | Lamberton | 405/239 |
| 3,438,212 | 8/1969 | Turzillo . | |
| 3,851,483 | 12/1974 | Holley, Jr. . | |
| 3,851,485 | 12/1974 | Steding | 405/239 X |
| 3,999,391 | 12/1976 | Meredith | 405/262 X |
| 4,038,827 | 8/1977 | Pryke | 405/239 |
| 4,060,994 | 12/1977 | Chitis | 405/239 X |
| 4,069,677 | 1/1978 | Yamada et al. | 405/262 X |
| 4,397,589 | 8/1983 | Darroussin et al. | 405/262 X |
| 4,411,557 | 10/1983 | Booth | 405/262 X |

FOREIGN PATENT DOCUMENTS

| | | | |
|---|---|---|---|
| 1904371 | 7/1970 | Fed. Rep. of Germany . | |
| 1634554 | 8/1970 | Fed. Rep. of Germany . | |
| 1908951 | 9/1970 | Fed. Rep. of Germany . | |
| 1609722 | 6/1971 | Fed. Rep. of Germany . | |
| 2041249 | 2/1972 | Fed. Rep. of Germany . | |
| 2019533 | 11/1975 | Fed. Rep. of Germany . | |
| 2627524 | 12/1976 | Fed. Rep. of Germany . | |
| 2606095 | 12/1976 | Fed. Rep. of Germany . | |
| 2649891 | 5/1978 | Fed. Rep. of Germany . | |
| 2806840 | 9/1978 | Fed. Rep. of Germany | 405/262 |
| 1443392 | 5/1966 | France . | |
| 2340484 | 2/1977 | France . | |
| 300486 | 10/1954 | Switzerland . | |
| 558453 | 1/1975 | Switzerland . | |

OTHER PUBLICATIONS

Excerpt from Book 6, Switzerland paper, dated Feb. 10, 1966, pp. 120–123.

*Primary Examiner*—Dennis L. Taylor

*Attorney, Agent, or Firm*—Karl F. Ross; Herbert Dubno

[57] ABSTRACT

The anchoring element has at least one anchor traction member 1 stressable against an abutment 3 and kept longitudinally movable in the ground by an envelope 5. An anchor body 6 is connected with this anchor traction member 1 at its end facing the bottom of the anchor bore. The anchor body 6 interacts with at least one pressure member 1' under pressure. This pressure member 1', cooperating with the surrounding compression body 2, is also extended, as a traction member 1' for tensioning against the abutment 3, up to the ground surface. The traction member 1' cooperating with the compression body 2 is this way used on one hand, for pressure, and on the other hand for traction.

11 Claims, 18 Drawing Figures

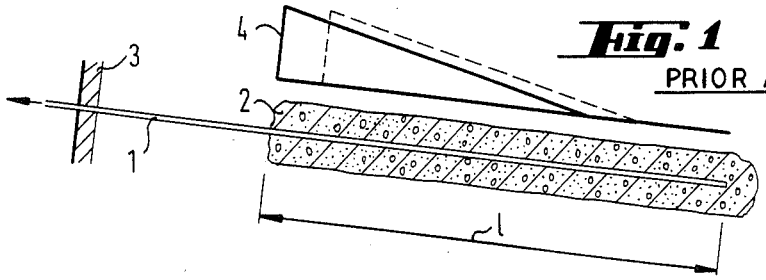
Fig. 1
PRIOR ART
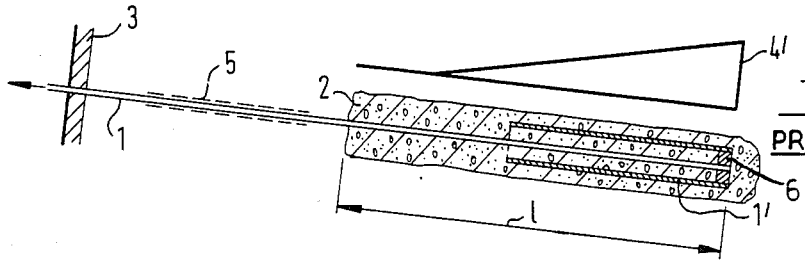
Fig. 2
PRIOR ART
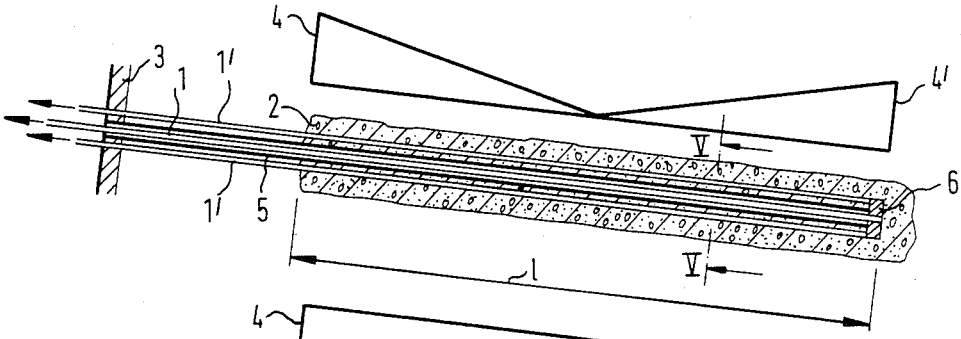
Fig. 3
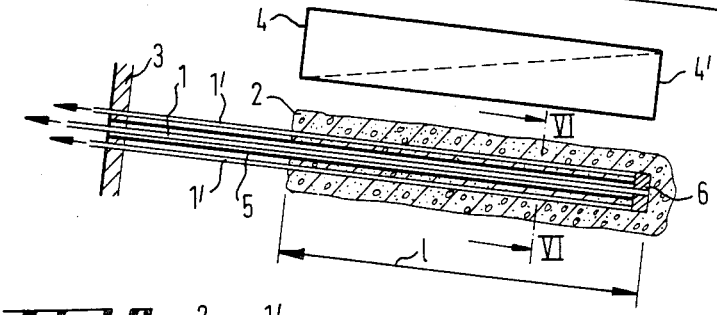
Fig. 4
Fig. 5
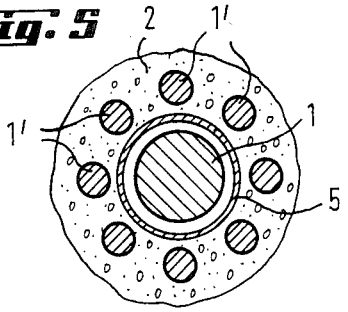
Fig. 6
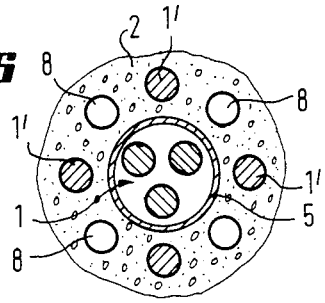

Fig. 7d
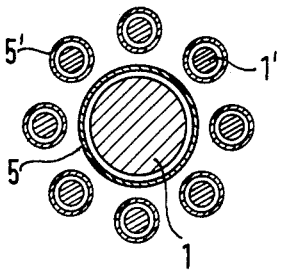
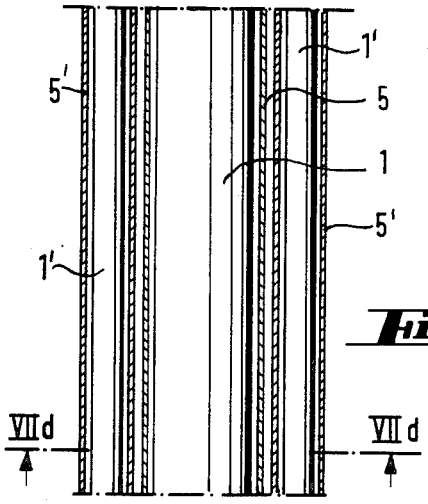
Fig. 7b
Fig. 7c
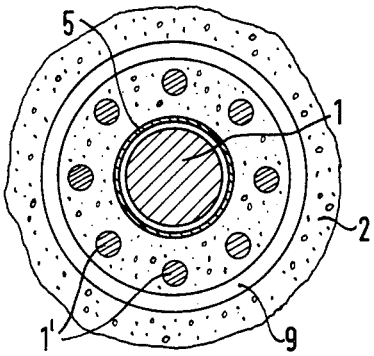
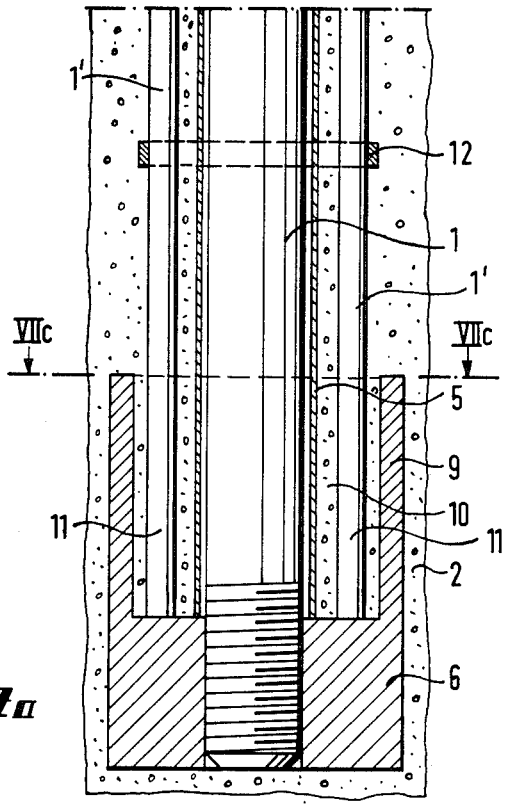
Fig. 7a 22
23
20
20'
20'
20
24
24
2
21

GROUND ANCHOR SYSTEM

CROSS REFERENCE TO RELATED APPLICATIONS

This application is a national phase application of PCT/DE85/00241 filed July 12, 1985 and based, in turn, upon a German national application No. P 34 25 941.4 of July 13, 1984 under the International Convention.

FIELD OF THE INVENTION

The invention relates to construction elements adapted to be seated in the foundation soil, such as anchoring rods and piles and, more particularly, to an anchor element of the type which has at least one anchoring member stressable against an abutment and extending thereto from the ground surface.

BACKGROUND OF THE INVENTION

From the article in the technical publication "Der Bauingenieur 51" (The Civil Engineer 51), 1976, page 110, it is known that there are anchoring elements of the types A and B. Anchoring elements of the type A transmit the combined stress from the tension member directly to the compression body. Anchoring elements of the type B transmit the combined stress over a pressure pipe in the compression body.

The A-type anchoring element has the disadvantage that the combined stress presents a peak at the beginning of the compression body and then decreases towards the end proximal to the bottom of the anchor bore. In a rough comparison, it can be said that the combined stress is distributed in the pattern of a triangle with the maximum at the beginning of the compression stretch and tending towards zero at the end of the compression stretch.

The anchoring element of the B type has the same disadvantage, but in the reverse manner, the combined stress has its maximum at the end proximal to the bottom of the bore and tends towards zero at the free end. It is disadvantageous in both anchor types that the combined stress is very unevenly distributed over the anchoring length, so that the anchor may be able to absorb the maximal combined stress.

A prestressable tensioning anchor having an inner rod-like tension member and an outer pipe-like tension member is known from German Pat. No. 20 19 533. Both tension members are connected at their ends facing the bottom of the bore. The opposite ends are connected with tensioning devices. The end facing the bore of the outer tension member is surrounded by a compression body extending over an anchoring stretch. In this known anchoring rod, the disadavantage consists in the fact that the tensioning device which prestresses the inner tension member is supported on the outer end of the pipe-like tension member. When the inner tension member is subjected to initial stress, no forces are introduced into the foundation soil. It is hereby only a matter of an inner state of tension. When the outer tension member is prestressed by means of the tensioning device resting on the foundation soil, forces are introduced into the ground. The maximum peak of the composite tension can be found at the beginning of the tensioning stretch, going towards zero at the end of the tensioning stretch. This known anchor behaves like the anchoring rod of the type A.

OBJECT OF THE INVENTION

It is the object of the invention to provide construction elements such as anchors, piles and the like, whose anchoring forces, and supporting capacities, are considerably increased and wherein the combined forces are more evenly distributed over the entire anchoring length.

SUMMARY OF THE INVENTION

According to the invention, this object is achieved with an anchor system having at least one anchoring member stressable against the abutment and extending from the ground through the ground surface to the abutment, an anchoring body at the end of this anchor member, a compression mass which surrounds the portion of the anchor member in the ground and the anchor body and is in direct contact with the ground, and at least one auxiliary traction member tensioned against the abutment and also extending to the anchor body. A sleeve or tube surrounds the main tension member with clearance, is affixed to the anchor body, and extends over at least the length of the subterranean portion of the main tension member, while the auxiliary tension member lies outside of this sleeve.

According to a feature of the invention, the main tension member is a central steel rod and the sleeve is an enveloping pipe extending the full length of the steel rod between the abutment and the anchor body at the foot of this rod, while a plurality of auxiliary traction members are provided in an array coaxially surrounding the pipe or sleeve and the central member.

The central member can also be made up of a plurality of individual strands or bars and between or among the strands or bars of the auxiliary member, additional iron elements can extend over the entire subterranean length of only part of it and can rest against the anchor body or are connected with it and can be in direct contact with the compression mass.

The anchor body can have an axially extending annular shoulder which receives the ends of the auxiliary members and, if desired, additional pipes may surround the auxiliary members.

The anchor body can be provided with circumferentially evenly distributed pockets or recesses for receiving the ends of the auxiliary members and, according to another feature of the invention, the array of auxiliary member can be surrounded by a steel pipe.

When a number of strands or bars form the central traction member, they are compressed into a head at the foot thereof and the anchor body is then formed by a portion of the mass which envelopes this foot of the main traction member, is surrounded by a steel pipe, and receives the lower ends of the auxiliary members and the aforementioned sleeve.

The compression stretch can be provided with a ribbed pipe of a synthetic material, inner and/or outer surfaces of the anchor parts can be profiled and rings can be provided around the array of auxiliary elements. Embodiments of the invention result from the dependent claims.

BRIEF DESCRIPTION OF THE DRAWING

The invention is explained in greater detail below with the aid of the drawing representing the embodiment examples. In the drawing:

FIG. 1 is a schematic side view of a known type A anchoring element with diagrammatic representation of the combined stress distribution;

FIG. 2 is a schematic side view of a known type B anchoring element with diagrammatic representation of the combined stress distribution;

FIG. 3 is a schematic side view of an anchoring element according to the invention, with diagrammatic representations of the combined stress distribution;

FIG. 4 is a view similar to FIG. 3 but showing a modification;

FIG. 5 is a schematic cross section along line V—V of FIG. 3;

FIG. 6 a schematic cross section along line VI—VI of FIG. 4;

FIG. 7*a* is a schematic partial longitudinal section of an anchoring element according to the invention in the area of the compression body;

FIG. 7*b* is a partial longitudinal section of the anchoring element of FIG. 7*a* in the area of the free anchor length;

FIG. 7*c* is a schematic cross section along to line VII*c*—VII*c* of FIG. 7*a;*

FIG. 7*d* is a schematic cross section along to line VII*d*–VII*d* of FIG. 7*b;*

SPECIFIC DESCRIPTION

Figure 8B:
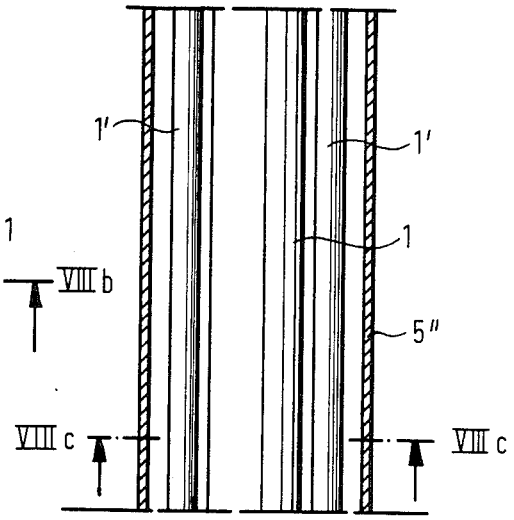
FIG. 8*b* is a partial longitudinal section of the anchor along to FIG. 8*a* in the area of the free anchor length.

The compression anchor of the A type, represented in FIG. 1 and known to the art, has a tension member 1, for instance in the shape of a tensioning steel strip. This tension member 1 which is inserted in a bore (not shown) is encased over its entire anchoring length with the hardened construction material. The hardening construction material, preferably cement, has direct composite action with the tension member. After the hardening of the construction material, the tension element 1 is stressed against the abutment member 3 in the direction of the arrow by a tensioning press not shown in the drawing.

At the junction between the construction material and the ground a combined stress is created, which in a rough approximation can be considered as having a triangularly shaped course along the compression stretch, as represented in the corresponding diagram 4. The maximum of the combined stress is present at the beginning of the compression stretch and decreases towards zero at the end deepest in the ground. When the absorbable combined pressure is surpassed, then, in rough approximation, the combined stress triangle slides towards the bottom anchor end, as shown in dotted lines. It is not possible to increase the absorbable anchoring force at will, just by increasing at will the length of the compression body 2. In the case of very long compression bodies, at the bottom end of the anchor the combined stress is very low or equals zero.

The known anchor of the B-type, schematically represented in FIG. 2, has again a traction member 1 in the shape of a tensioning steel strip. This traction member 1 is surrounded by an enveloping pipe 5 (short stretch indicated in dotted line) which serves to keep the tension member 1 free from direct interaction with the compression body 2. At the bottom end, the tension member 1 is connected with an anchor body 6. A pressure member 1', which is generally pipe-shaped, is connected with the body 6, this pressure member surrounding the traction member 1 concentrically. The traction member 1 is again stressed by a tensioning press (not shown) in the direction of the arrow against an abutment element 3. At the junction between construction material and the soil, again, the pattern of the combined stress diagram 4' roughly approximates a triangle shape. However, this pattern now has its peak oriented towards the bottom end of the compression stretch.

The anchor schematically represented in FIG. 3 has at least two traction members 1 and 1', which are directly or indirectly connected over the anchor body 6 at their bottom ends. The traction member 1 is provided over its entire length with an enveloping pipe 5, in accordance with the type B anchor of FIG. 2, so that there is no interaction with the compression body 3. The traction member 1', which is not surrounded by a pipe in the area of the compression body, is preferably profiled or ribbed and in direct interaction with the compression body, and is also directly or indirectly in contact with the anchoring body 6 at the bottom end of the traction member 1. Thereby, the bottom end stretch of the tension member 1' is stressed via the tension member 1 and the anchoring body 6.

The traction member 1 as well as the traction member 1' are stressed in the directions indicated by arrows towards the abutment element 3 by tensioning presses, not shown in the drawing.

As can be seen from FIG. 5, the traction member 1 can be made of a single steel traction element, provided with the enveloping pipe 5, The traction member 1' is made of individual bars and/or wire strands, arranged concentrically to the traction member 1.

As can be seen from FIG. 6, the central traction member 1 can also consist of several, in this case three, individual bars or wire strands, which again are surrounded by a common enveloping pipe 5. In addition, between the tension members 1', in the end areas, supplementary iron elements 8 are inserted, which are connected directly or indirectly with the anchoring body 6 at their bottom ends, while their other ends extend freely towards the end of the compression stretch. These additional iron elements 8 form the pressure member together with the end portions of the traction member 1'.

As can be seen from FIG. 3, due to the tensioning of the traction members 1 and 1' against the abutment member 3, when the compression stretch has a sufficient length L at the junction between construction material and soil, the combined stress patterns follow successively the diagrams 4 and 4'. The combined stress diagram 4, corresponding to the A-type anchoring element is followed by the invertedly shaped combined stress diagram 4' of the B-type anchor.

It results therefrom that, with the anchoring element according to the invention, an anchoring force is brought into effect which is approximately as high as the anchoring force of the anchors of type A and B combined, but with considerable less boring operations then in the case of separate construction of an anchoring element of the A-type and an anchoring element of the B type.

In the anchoring element according to FIG. 4, there is a tendency to achieve a combined stress pattern which in a rough approximation has the shape of a rectangle.

This presumes an equal tensioning force of both traction elements 1 and 1', as well as a particular dimensioning of the length of the compression stretch.

In the professional publication "Der Bauingenieur 51" (The Civil Engineer 51), 1976, Vol. 3, on page 113, dimensioning diagrams are published which indicate the anchoring support force which can be reached for a certain compression stretch length L, from where also the dimensions of the traction elements 1 and 1' can be calculated. In order to produce the same tensioning forces when simultaneously stressing both traction members 1 and 1', a special press is required which takes into consideration the various free lengths of steel in the traction members 1 and 1'.

When a rectangular pattern of the combined stress is reached, a higher anchoring force with the same anchor length is attainable in comparison with an A- or B-type anchor, a fact that has considerable economic significance.

When the tensioning force of the traction member 1 and 1' can not be brought to equal values through the arrangement of the traction members, a trapezoidal pattern of the combined stress results, with only slightly reduced economic efficiency.

From FIG. 7*a*, the construction of the anchoring element in the area of the compression body 2 is more clearly visible. The traction member 1, formed by a steel bar, is for instance screwed into the anchoring body 6. It is surrounded by the enveloping pipe 5, which is for instance a tube made of synthetic material. This enveloping pipe 5 reaches over the entire length of the traction member 1, up to the anchoring body 6. In the area of the compression body, this enveloping pipe 5 can be made entirely of steel or only over a certain stretch, in order to counteract more efficiently an inward buckling of the pressure bars. The enveloping pipe 5 can also have an outer profiling and, this way, also take over the function of a pressure pipe. The anchoring body 6 has at its circumference an annular shoulder 9. In the annular space 10, between enveloping pipe 5 and shoulder 9, the bottom ends 11 of the traction members 1' are inserted in the form of individual bars. The hardening construction material, which is also pressed into the annular space 10 binds together the anchoring bodies 6 and the ends 11 of the traction members 1'. The annular shoulder 9 prevents the retraction of the construction material and absorbs the split traction forces. When the annular shoulder 9 is correspondingly extended and profiled on the outside, it can also assume the function of a pressure pipe, and relieve partially the bars and wirestrands under stress. The ends 11 of the traction members 1', which act as pressure members in their end portions, are braced by strips 12 against buckling.

As can be seen from FIG. 7*d*, the traction member 1, as well as the traction members 1', are surrounded by enveloping pipes 5, or 5' in the area of the free anchor length. In the anchoring element according to FIGS. 8*a*, 8*b* and 8*c*, the anchor body 6 is provided with cylindrical pocket recesses 13 arranged circumferentially, with equal intervals between them. The bottom extremities of the traction members 1' are insertably received in these recesses.

Figure 8C:
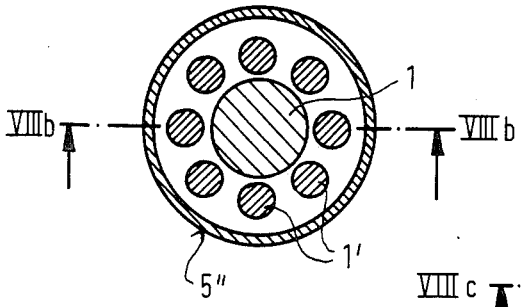
FIG. 8*c* is a schematic cross section along to line VIII*c*—VIII*c* of FIG. 8*b;*
Figure 8A:
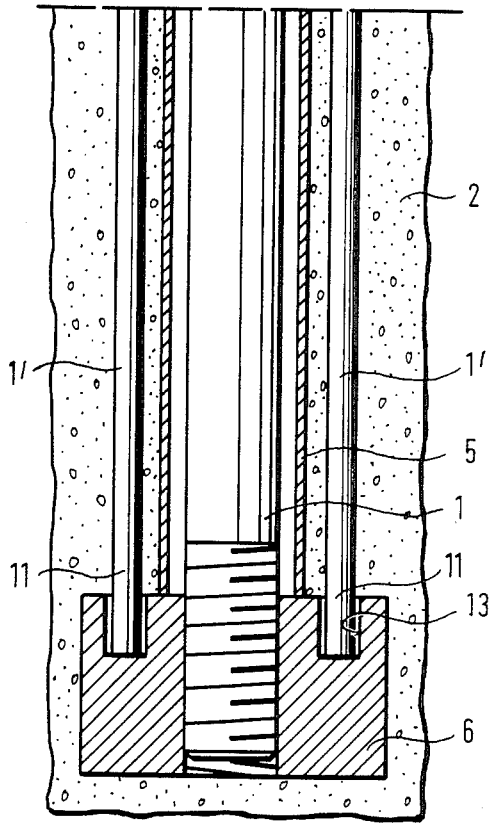
FIG. 8*a* is a partial longitudinal section of an anchor according to the invention in a further modified embodiment in the area of the compression body.

In the case of the anchor portion extending over the free anchor stretch according to FIG. 8*b*, the traction members 1 and 1' are surrounded by a common enveloping pipe 5''.

Figure 9A:
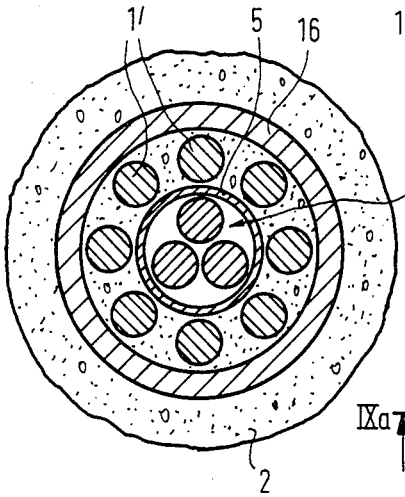
FIG. 9*a* is a schematic cross section along to the line IX*a*—IX*a* of FIG. 9.
Figure 9:
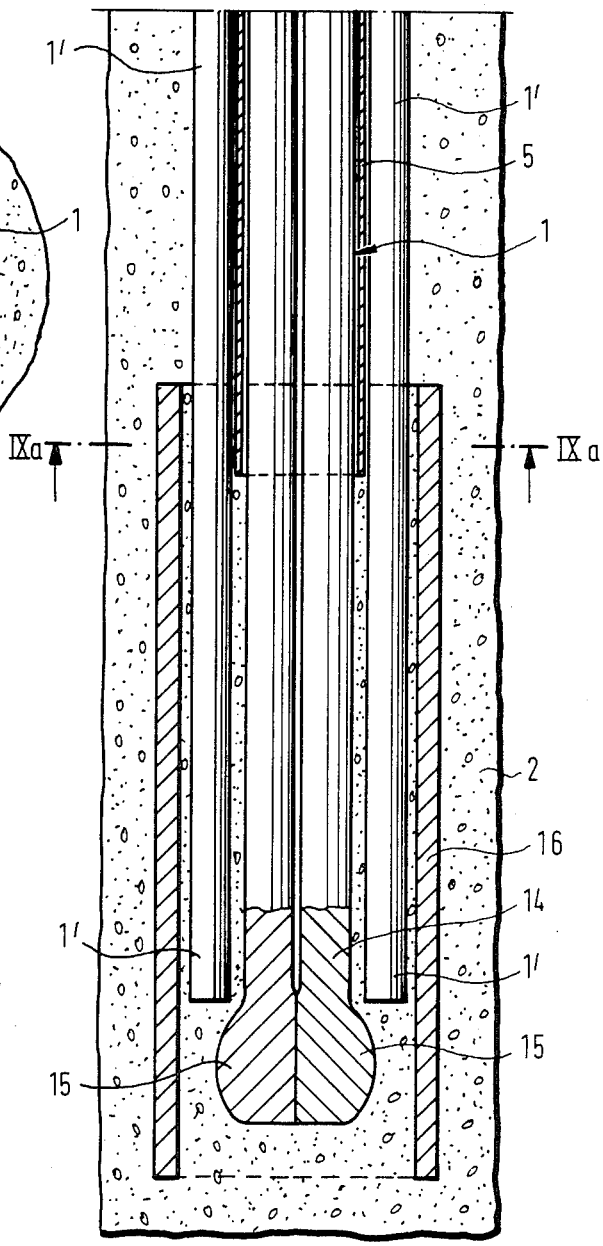
FIG. 9 is a schematic partial longitudinal section of an anchoring element according to the invention in a further embodiment in the area of the compression body.

In the anchor embodiment according to FIG. 9, the anchor body 6 is replaced by a thickening 15 of the ends of the bars or wirestrands forming the traction member 1, due to compression. The resulting thickening transmits the traction force over the hardening construction material of the compression body 2 to the ends of the traction members 1', forming the pressure member. A piece of steel pipe 16, which surrounds the end of the traction member 1 and the ends of the traction members 1', absorbs the split traction forces and prevents a retraction of the hardened construction material. The afore-described anchor body 6 is thus replaced by the thickening 15, the compression body 2 and the steel pipe piece 16. The steel pipe piece 16 can have inner, as well as outer profiling, and assume this way also a pressure-pipe function.

The anchors according to FIGS. 3–9 can also be additionally surrounded by plastic ribbed pipe, not shown in the drawing, in the area of the compression stretch, which serves as additional corrosion protection for permanent anchoring elements.

Figure 10:
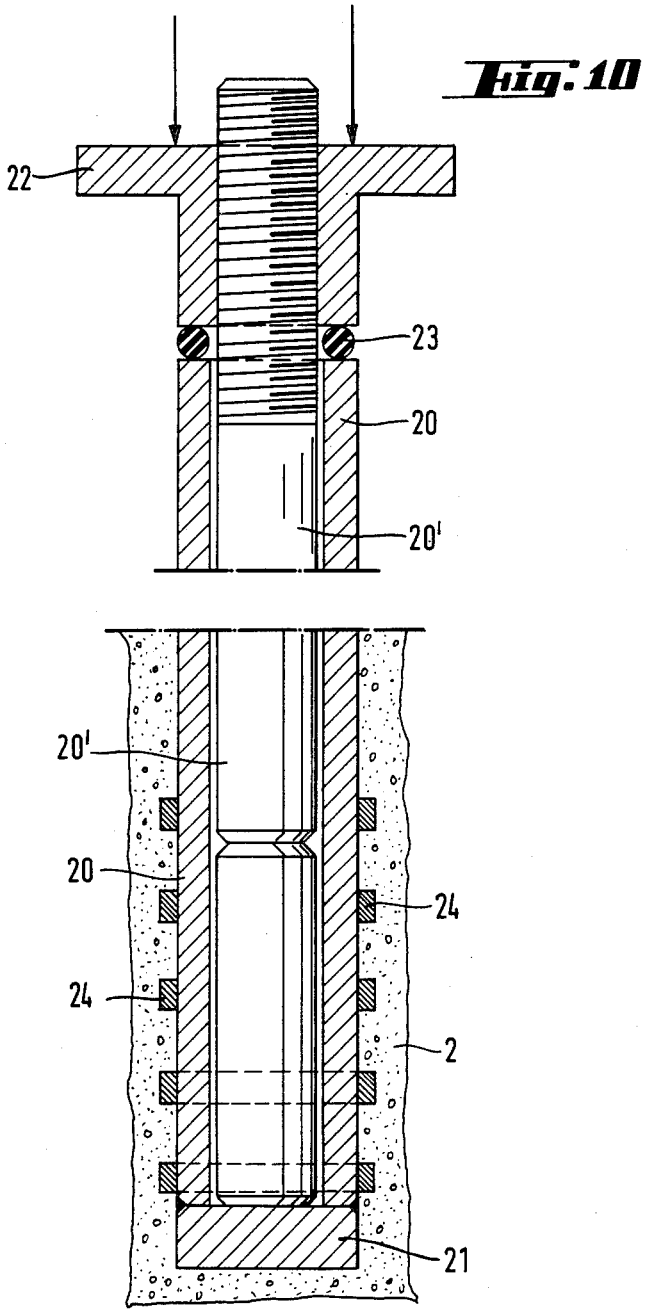
FIG. 10 is a schematic cross section through a pile according to the invention.

The steel pile represented in FIG. 10 has an outer pipe 20; this can also consist of individual pieces connected by couplings. The inner bar 20' can also be made of individual pieces, which abut on each other, without special connecting elements. An end cap 21 is for instance welded to the outer pipe 20, on which the inner bar 20' is supported. The outer pipe 20 and the inner bar 20' are set under load for instance over the pile top plate 22 by a foundation indicated with arrows. The pile top plate is connected to the inner rod 20' by for instance a thread, through which the pile top plate can be adjusted to a certain theoretical height. A compressible or squeezeable mass 23 separates first the frontal surface of the outer pipe 20 from the frontal surface of the annular flange of the pile top plate 22.

The mass 23 is a distance-keeping element and has also sealing properties with respect to the penetrating cement.

The height of the mass 23 has to take into account the various elastic compressions resulting from the various effective lengths of the outer pipe 20 and the inner rod 20'. Only when these elastic length diferrence, which is bigger in the case of the inner rod 20' than in the case of the outer steel pipe 20, is absorbed, the two frontal surfaces are to be fully frictionally connected.

When the same cross section is selected for the outer pipe 20 and the inner rod 20' and the force-transmitting length of the compression body 2 provided with interaction ribs 24 is selected with respect to the soil, then, if one disregards the anyway minimal force reduction due to peak pressure, a combined pressure surface roughly approximating a rectangular shape, results also in this case.

Figure 11:
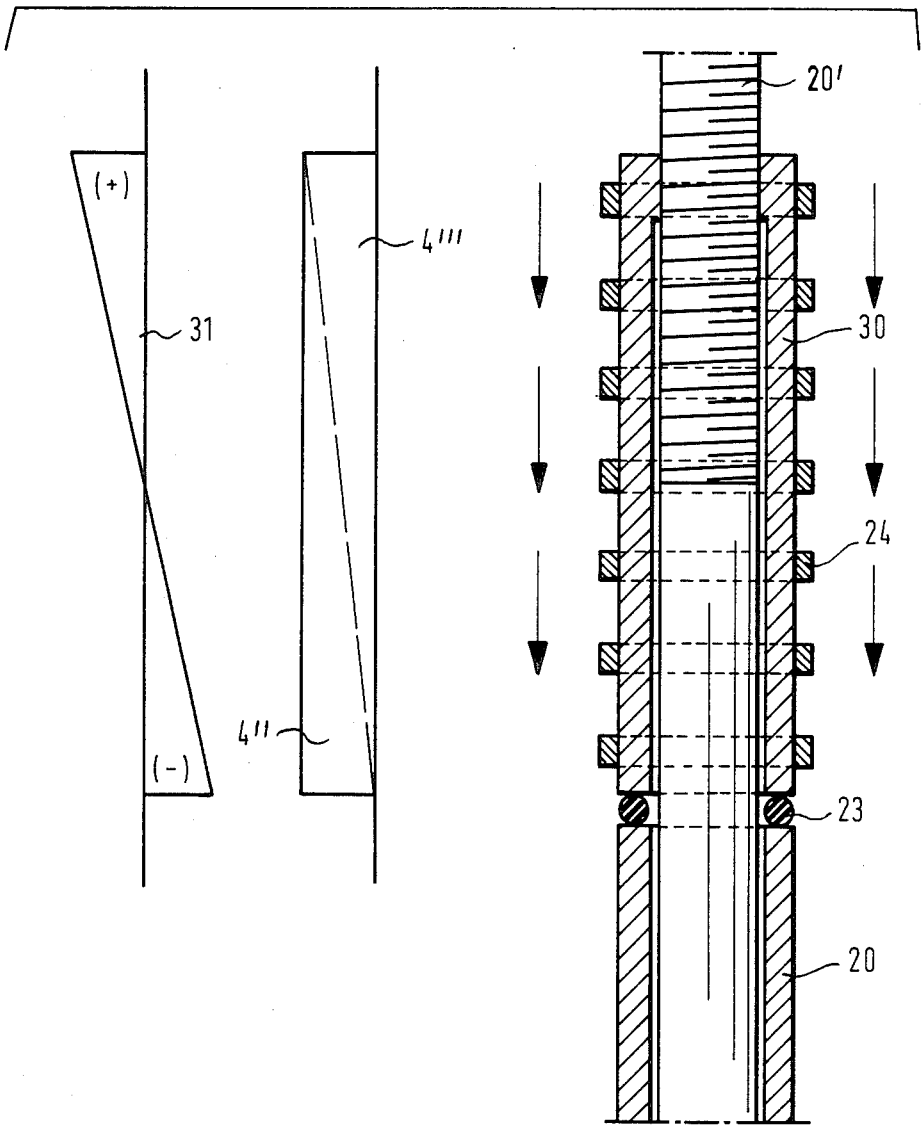
FIG. 11 is a schematic partial longitudinal section of a pile according to a modified embodiment.

The steel pile represented in FIG. 11 has a modified construction of the pile head. The steel pile is set under load by a foundation, which transmits the loads via combined stresses indicated by arrows to a pipe-like pile-head body 30. This pile-head body 30 is connected to the inner rod 20', for instance, through a threading. A compressible or squeezable mass 23 is again used as a preliminary separating element and the threading allows here too a precise height adjustment.

In the case of even force distribution between the pipe-like pile 20 and the inner rod 20', a rectangularly shaped pattern of the combined stress as in 4 and 4' results not only along the force-transmitting stretch in the foundation soil, but also along the force-transmitting length in the foundation area, a pattern of the combined stress which can roughly by approximated with a rectangular shape 4'' and 4''', results, with the corresponding advantages for the absorption of the pile force in poor or not tested concrete.

Also interesting is the normal stress pattern 31 resulting from this construction in the pile body 30. The traction area (+) results in a cross contraction and the compression range (−) results in a cross expansion. A cross expansion increases the absorbable combined stress, a cross contraction diminishes it. This can be counterbalanced by minimal variations in the force distribution between the pipe-like pile 20 and the inner rod 20'.

Figure 12:
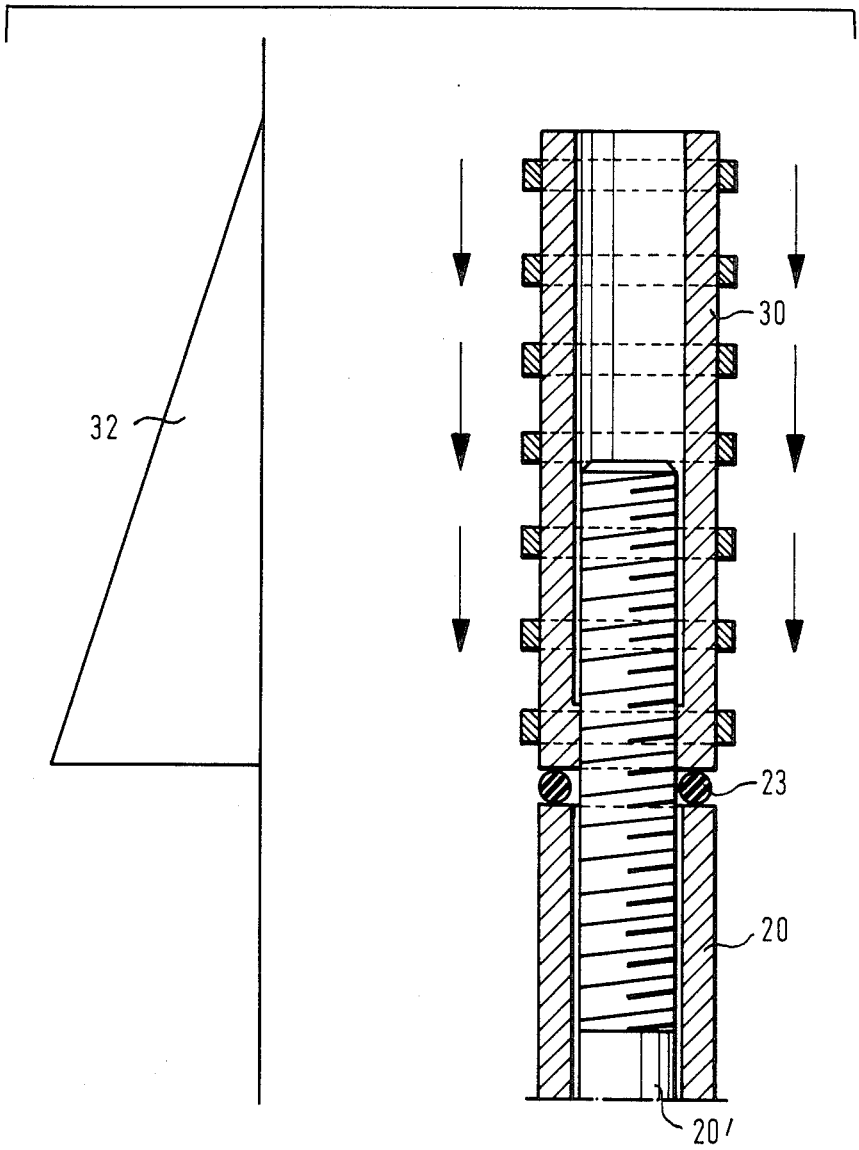
FIG. 12 is a schematic partial longitudinal section of a pile in accordance with a further embodiment.

It can also be advantageous to reverse the pile-head body 30, as shown in FIG. 12. Hereby, only pressure stress appears in the pile-head body 30, as indicated by the normal stress diagram 32.

Through cross expansion, the absorbable combined stress is improved, a fact which can be advantageous in the case of foundations which have been correspondingly tested.

We claim:

1. A ground anchor system comprising:

an abutment at a side of a ground surface opposite the ground;

an elongated main tension member having a subterranean portion of its length extending into and adapted to be anchored in the ground below said surface, said elongated main tension member having a free portion of its length between said surface and said abutment and being tensioned against said abutment;

an anchor body in the ground at a foot of said main tension member in the ground remote from said abutment, said main tension member being fixed to said anchor body;

a sleeve spacedly surrounding said main tension member over at least said subterranean portion and fixed to said anchor body;

a compression mass surrounding said sleeve, said subterranean portion and said anchor body in direct contact with said anchor body and said sleeve and with the surrounding ground over the length of said subterranean portion, said sleeve separating said subterranean portion of said tension member from direct contact with said mass; and at least one auxiliary tension member extending to said anchor body, passing through said mass outwardly of said sleeve and tensioned against said abutment.

2. The ground anchor system defined in claim 1 wherein said sleeve extends substantially to said abutment and a plurality of said auxiliary tension members are provided in an array coaxially surrounding said sleeve and said main tension member.

3. The ground anchor system defined in claim 2 wherein said main tension member comprises a plurality of strands.

4. The ground anchor system defined in claim 2 wherein at least some of said auxiliary tension members each comprise a plurality of strands.

5. The ground anchor system defined in claim 2 wherein a plurality of insert iron rods are inclined in said array and extend at least over part of the length of said subterranean portion.

6. The ground anchor system defined in claim 2 wherein said main tension member is threaded into said anchor body and said anchor body is formed with an annular axially extending shoulder receiving lower ends of said auxiliary tension members.

7. The ground anchor system defined in claim 2 wherein said auxiliary tension members are surrounded with respective auxiliary sleeves at least between said surface and said abutment.

8. The ground anchor system defined in claim 7 wherein said anchor body is formed as circumferentially uniformly distributed pockets around the sleeve surrounding said main tension member and receiving respective lower ends of said auxiliary tension members.

9. The ground anchor system defined in claim 2, further comprising an additional sleeve surrounding said array between said surface and said abutment.

10. The ground anchor system defined in claim 2 wherein the strands of said main tension member are formed into a head, said head being surrounded by a portion of said compression mass and a pipe to form said anchor body therewith.

11. The ground anchor system defined in claim 2 wherein portions of said system in contact with said mass are profiled.

* * * * *